US006660923B2

(12) United States Patent
Sato

(10) Patent No.: US 6,660,923 B2
(45) Date of Patent: Dec. 9, 2003

(54) METHOD FOR EXTRACTING THE FORMANT OF A MUSICAL TONE, RECORDING MEDIUM AND APPARATUS FOR EXTRACTING THE FORMANT OF A MUSICAL TONE

(75) Inventor: Hiroshi Sato, Hamamatsu (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 165 days.

(21) Appl. No.: 10/033,801

(22) Filed: Jan. 3, 2002

(65) Prior Publication Data

US 2002/0124713 A1 Sep. 12, 2002

(30) Foreign Application Priority Data

Jan. 9, 2001 (JP) ..... 2001-001409
Dec. 10, 2001 (JP) ..... 2001-375423
Dec. 25, 2001 (JP) ..... 2001-392305

(51) Int. Cl.[7] ..... G10H 7/00
(52) U.S. Cl. ..... 84/607; 704/209
(58) Field of Search ..... 84/607, 608; 704/209

(56) References Cited

U.S. PATENT DOCUMENTS 5,463,716 A * 10/1995 Taguchi ..... 704/209
6,115,684 A * 9/2000 Kawahara et al. ..... 704/203
6,195,632 B1 * 2/2001 Pearson ..... 704/206

FOREIGN PATENT DOCUMENTS

JP 8-221099 8/1996
JP 9-210763 8/1997

* cited by examiner

*Primary Examiner*—Jeffrey Donels
(74) *Attorney, Agent, or Firm*—Oblon, Spivak, McClelland, Maier & Neustadt, P.C.

(57) ABSTRACT

There are provided a power line spectrum extractor for extracting power line spectra of a waveform to be processed; a level interpolation controller for performing level interpolation control on the power line spectra at every unit of a certain frequency, which is not higher than half a sampling frequency; and a cepstrum analyzer for performing Fast Fourier Transformation on the power spectra subjected to the level interpolation control and performing Inverse Fast Fourier Transformation on values found by performing level setting with a specified coefficient.

7 Claims, 14 Drawing Sheets

METHOD FOR EXTRACTING THE FORMANT OF A MUSICAL TONE, RECORDING MEDIUM AND APPARATUS FOR EXTRACTING THE FORMANT OF A MUSICAL TONE

CROSS-REFERENCE TO RELATED APPLICATIONS

The present application claims priorities under 35 U.S.C. §119 to Japanese Patent Application No. 2001-001409, filed on Jan. 9, 2001 and entitled "Method for extracting formants of a musical tone, recording medium and apparatus for extracting formants of a musical tone", Japanese Patent Application No. 2001-375423, filed on Dec. 10, 2001 and entitled "Method for extracting formants of a musical tone, recording medium and apparatus for extracting formants of a musical tone", and Japanese Patent Application No. 2001-392305, filed on Dec. 25, 2001 and entitled "Method for extracting formants of a musical tone, recording medium and apparatus for extracting formants of a musical tone". The contents of these applications are incorporated herein by reference in their entirety.

BACKGROUND OF THE INVENTION

1. Field of the Invention

The present invention relates to a method for extracting formants of waveform data of a sampled musical tone, a recording medium and an apparatus for extracting formants of a musical tone.

2. Discussion of Background

Frequency characteristics are ones that show the characteristics of a musical tone waveform. Usually, line spectra are found by FFT (Fast Fourier Transformation) and are evaluated as the frequency characteristics. However, it is difficult to grasp the entire characteristics since too much detailed information is contained.

When the line spectra found by the FFT are smoothed to obtain formants, and when the formants are evaluated as the frequency characteristics of the musical tone waveform, it is easier to grasp the entire characteristics, and, e.g., treatment of the waveform becomes easier.

As a method for obtaining formants, it has been proposed to find formants by performing cepstral analysis.

The cepstrum is one that is obtained by performing FFT on an input signal, taking logarithms of the amplitude spectra of the transformed input signal and then performing Inverse FFT on the logarithms. The dimension is called quefrency. The quefrency has the same dimension as time. The fine structure of spectra appears at a higher quefrency, and the spectral envelope (formants) appears at a lower quefrency.

The cepstral analysis means that only parts having a lower quefrency at the dimension of quefrency are extracted (Hereinbelow, the maximum quefrency on extraction will be called the coefficient of the cepstral analysis.), and that FFT is performed on the extracted parts to extract formants of an input signal.

FIG. 12 shows a case wherein the coefficient of the cepstral analysis is 80, and FIG. 13 shows a case wherein the coefficient of the cepstral analysis is 40.

However, even after the cepstral analysis, minute fluctuations due to harmonic components remain, and the positions and the levels of peaks have changed in comparison with the original data as in the case shown in FIG. 12. When the coefficient is decreased to reduce fluctuations due to harmonic components, wide fluctuations are also lost, failing to show the characteristics of the original data, as shown in FIG. 13.

In the cepstral analysis, peaks are lowered under the influence of valleys between line spectra, and not only minute fluctuations at harmonic component levels but also wide fluctuations in the entirety are lost.

In the case of a normal musical tone, there is occurred a case wherein although the fundamental tone level is the greatest and harmonic component levels become smaller as the frequency increase, levels in the vicinity of the fundamental tone level (in particular, frequency components not higher than the fundamental tone) become smaller under the influence of valleys that are not higher than the fundamental tone.

SUMMARY OF THE INVENTION

The present invention is provided in consideration of these problems and proposes a method for extracting formants that reflect the entire characteristics of the waveform data of an original musical tone with fidelity, a recording medium with a program capable of performing the extracting method saved thereto, and an apparatus for extracting formants of a musical stone.

From the viewpoints, the method for extracting formants of a musical tone according to a first aspect of the present invention is basically characterized in that the method carries out the steps of:

finding power line spectra of a waveform to be processed;

performing level interpolation control on the power line spectra at every unit of a certain frequency, which is up to and including half a sampling frequency;

performing Fast Fourier Transformation or Inverse Fast Fourier Transformation on ones obtained by connecting peaks of harmonic components by the level interpolation control;

performing level setting with a specified coefficient to smooth a spectral envelope to be obtained as formants later on; and obtaining the spectral envelope by performing Inverse Fast Fourier Transformation or Fast Fourier Transformation on values that are found by performing the level setting with the specified coefficient.

The arrangement according to the first aspect can be free from minute fluctuations due to harmonic components, can prevent peaks from lowering by eliminating valleys between line spectra with the level interpolation control before the cepstral analysis, and can prevent levels in the vicinity of the fundamental tone (in particular, frequency components not higher than the fundamental tone) from becoming smaller under the influence of valleys that are not higher than the fundamental tone, thereby obtaining formants that represent the characteristics of the original data in terms of all respects, such as the positions and the levels of the peaks.

The reason why the level interpolation control is limited to the frequencies that are up to and including half a sampling frequency is that the frequency equal to half a sampling frequency is an upper limit according to the sampling theorem. The certain frequency for the level interpolation control may be arbitrarily set as long as the cycle is not beyond the upper limit.

The arrangement according to a second aspect of the present invention is directed to one of the ways of carrying out the level interpolation control in the level interpolation control step, which specifically comprises the steps of finding a frequency F1 and a level L1 of a spectrum having a maximum level before and after a fundamental tone of the waveform; bringing all levels of the power line spectra at 0 up to the frequency F1 into L1; repeating processing wherein, at every frequency that is an integral multiply of a frequency of the fundamental tone and is up to and including half the sampling frequency, a frequency Fn and a level Ln of a spectrum having a maximum level are found before and after the respective integral multiple frequencies, and the levels from the frequency having subjected to the level control at the previous stage to the frequency Fn are controlled to have values interpolated from a level Ln−1 to the level Ln; finding a frequency FN and a level LN of a last harmonic component; and bringing all levels from the frequency FN up to the frequency of the last harmonic component set for the level interpolation control to LN, thereby performing level interpolation control to connect peaks of harmonic components with the result that valleys not higher than the fundamental tone or valleys between line spectra are eliminated.

The arrangement according to a third aspect of the present invention is directed to another example of the ways of carrying out the level interpolation control in the level interpolation control step, which specifically comprises the steps of finding a frequency F1 and a level L1 of a spectrum having a maximum level before and after a fundamental tone of the waveform; bringing all levels of the power line spectra at 0 up to the frequency F1 into L1; repeating processing wherein a frequency Fn and a level Ln of a spectrum having a maximum level are found before and after respective frequencies that are obtained by adding the frequency of the fundamental tone to a frequency Fn−1 found at the previous stage and are up to and including half the sampling frequency, and the levels from the frequency Fn−1 to the frequency Fn found at the previous stage are controlled to have values interpolated from a level Ln−1 to the level Ln; finding a frequency FN and a level LN of a last harmonic component; and bringing all levels from the frequency FN up to the frequency of the last harmonic component set for the level interpolation control to LN, thereby performing the level interpolation control to connect peaks of harmonic components with the result that valleys not higher than the fundamental tone or valleys between line spectra are eliminated.

The difference to the arrangement according to the second aspect is that the level interpolation control of the power line spectra, which is carried out at every unit of the certain frequency, is carried out at every frequency that is obtained by adding the frequency of the fundamental tone to the frequency subjected to the level interpolation control at the previous stage, not at every frequency that is integral multiplies of the frequency of the fundamental tone. Although the way according to the second aspect does not always get the shape of the formants at high frequencies in alignment with the locations of the peaks of the harmonic components and cannot avoid misalignment in some cases, the way according to the third aspect can get the shape of the formants in alignment with the points of the peaks of the harmonic components and can avoid misalignment to represent the characteristics of the original data with more fidelity in terms of the locations and the levels of the peaks since the level interpolation control is carried out with a subsequent peak point being found while adding the frequency of a fundamental tone to the peak point at the previous stage.

In other words, when the peaks of data wherein the distance between harmonic components expands as the degree of harmonic components increases as in a piano are extracted at every certain section by a computer, the extracting section is divided at an intermediate point between peaks of harmonic components as shown in the vicinity of 8 KHz in FIG. 14 to create a problem in that it becomes impossible to extract the peak of a harmonic component successfully. Even in such a case, the level interpolation control by the arrangement according to the third aspect can get the shape of the formants in alignment with the points of the peaks of the harmonic components and can avoid misalignment since the level interpolation control is carried out with a subsequent peak point being found while adding the frequency of a fundamental tone to the peak point at the previous stage.

The arrangements according to fourth to sixth aspects of the present invention are directed to a recording medium, which saves a computer-executable program to cause a computer to execute the steps recited in each of the arrangements according to the first to third aspects. In other words, as the arrangement for solving the problems stated earlier, the present invention discloses a recording medium, which saves a program executable by a computer. The arrangements according to the fourth to six aspects may be provided not only as a recording medium but also as a program for attaining similar functions. In this case, the computer may be an exclusive machine directed to specific processing, besides a general-purpose computer with a central processing unit included therein, and there is no particular limitation on the computer as long as it includes a central processing unit.

When the program for causing a computer to execute the processing steps stated earlier is read out from the recording medium by the computer, processing steps similar to the processing steps recited in the first to third aspects are executed.

Among them, the arrangement of the fourth aspect corresponds to the arrangement according to the first aspect and is directed to a computer-readable recording medium, which specifically has a program saved thereto, the program causing a computer to perform the steps;

finding power line spectra of a waveform to be processed;

performing level interpolation control on the power line spectra at every unit of a certain frequency, which is up to and including half a sampling frequency;

performing Fast Fourier Transformation or Inverse Fast Fourier Transformation on the power spectra subjected to the level interpolation control;

performing level setting with a specified coefficient; and performing Inverse Fast Fourier Transformation or Fast Fourier Transformation on values found by performing the level setting with the specified coefficient.

The arrangement according to the fifth aspect corresponds to the arrangement according to the second aspect. Specifically, the arrangement is characterized in that the step of performing the level interpolation control comprise finding a frequency F1 and a level L1 of a spectrum having a maximum level before and after a fundamental tone of the waveform; bringing all levels of the power line spectra at 0 up to the frequency F1 into L1; repeating processing wherein, at every frequency that is an integral multiply of a frequency of the fundamental tone and is up to and including half a sampling frequency at a maximum, a frequency Fn and a level Ln of a spectrum having a maximum level are found before and after the respective integral multiple frequencies, and the levels from the frequency having subjected to the level control at the previous stage to the frequency Fn are controlled to have values interpolated from a level Ln−1 to the level Ln; finding a frequency FN and a level LN of a last harmonic component; and performing level interpolation control to connect peaks of harmonic components by bringing all levels from the frequency FN up to the frequency of the last harmonic component set for the level interpolation control to LN.

The arrangement according to the sixth aspect corresponds to the arrangement according to the third aspect. Specifically, the arrangement is characterized in that the step of performing the level interpolation control comprises finding a frequency F1 and a level L1 of a spectrum having a maximum level before and after a fundamental tone of the waveform; bringing all levels of the power line spectra at 0 up to the frequency F1 into L1; repeating processing wherein a frequency Fn and a level Ln of a spectrum having a maximum level are found before and after respective frequencies that are obtained by adding the frequency of the fundamental tone to a frequency Fn−1 found at the previous stage and are up to and including half a sampling frequency, and the levels from the frequency Fn−1 to the frequency Fn found at the previous stage are controlled to have values interpolated from a level Ln−1 to the level Ln; finding a frequency FN and a level LN of a last harmonic component; and performing level interpolation control to connect peaks of harmonic components by bringing all levels from the frequency FN up to the frequency of the last harmonic component set for the level interpolation control to LN.

By providing a recording medium with any one of the arrangements stated earlier, the arrangement for executing the processing steps recited in any one of the first to third aspects can be distributed as a software product. By utilizing the software in an existing hardware resource, the arrangements according to the present invention can be easily implemented as a new application in the existing hardware resource. It is needless to say that besides that sort of recording medium, an internal storage, such as a RAM and a ROM, and an external storage, such as a hard disk, are included as the recording medium covered by the present invention as long as the program stated earlier is saved thereto.

One of the processing steps in any one of the fourth to sixth aspects may be implemented by a function incorporated in a computer (which may be a function incorporated as a part of a hardware in a computer, or a function realized by the operating system incorporated in a computer, another application system or the like), and the program saved to the recording medium may include a command to call or link to the function to be performed by the computer.

This is because a substantially similar arrangement can be provided as long as a part of the processing steps recited in the fourth to sixth aspects is taken over by a part of the functions attained by, e.g., an operating system for attaining the functions and as long as the part of the functions of the operating system is configured to be called or linked, though neither program nor module for realizing that function is directly saved to the recording medium.

Additionally, a seventh aspect of the present invention is directed to the structure of an apparatus with the arrangement stated earlier, which is characterized to specifically comprise

- a power line spectrum extractor, which extracts power line spectra of waveform to be processed;
- a level interpolation controller, which performs level interpolation control on the power line spectra at every unit of a certain frequency, which is up to and including half a sampling frequency; and
- a cepstrum analyzer, which performs Fast Fourier Transformation or Inverse Fast Fourier Transformation on the power spectra subjected to the level interpolation control and performs Inverse Fast Fourier Transformation or Fast Fourier Transformation on values found by performing level setting with a specified coefficient.

As explained, the method for extracting formants of a musical tone, the recording medium and the apparatus for extracting formants of a musical tone according to the first to seventh aspects of the present invention can offer advantages that it becomes possible to obtain formant data wherein components in the vicinity of a fundamental tone (in particular frequency components not higher than the fundamental tone) can be prevented from getting smaller, the levels of harmonic components inherent in the waveform are reflected with fidelity, a rough shape of the frequency characteristics is represented, and the characteristics of the original power line spectra are clearly represented.

DETAILED DESCRIPTION OF THE PREFERRED EMBODIMENTS

Now, embodiments of the present invention will be described along with the shown examples.

Figure 1:
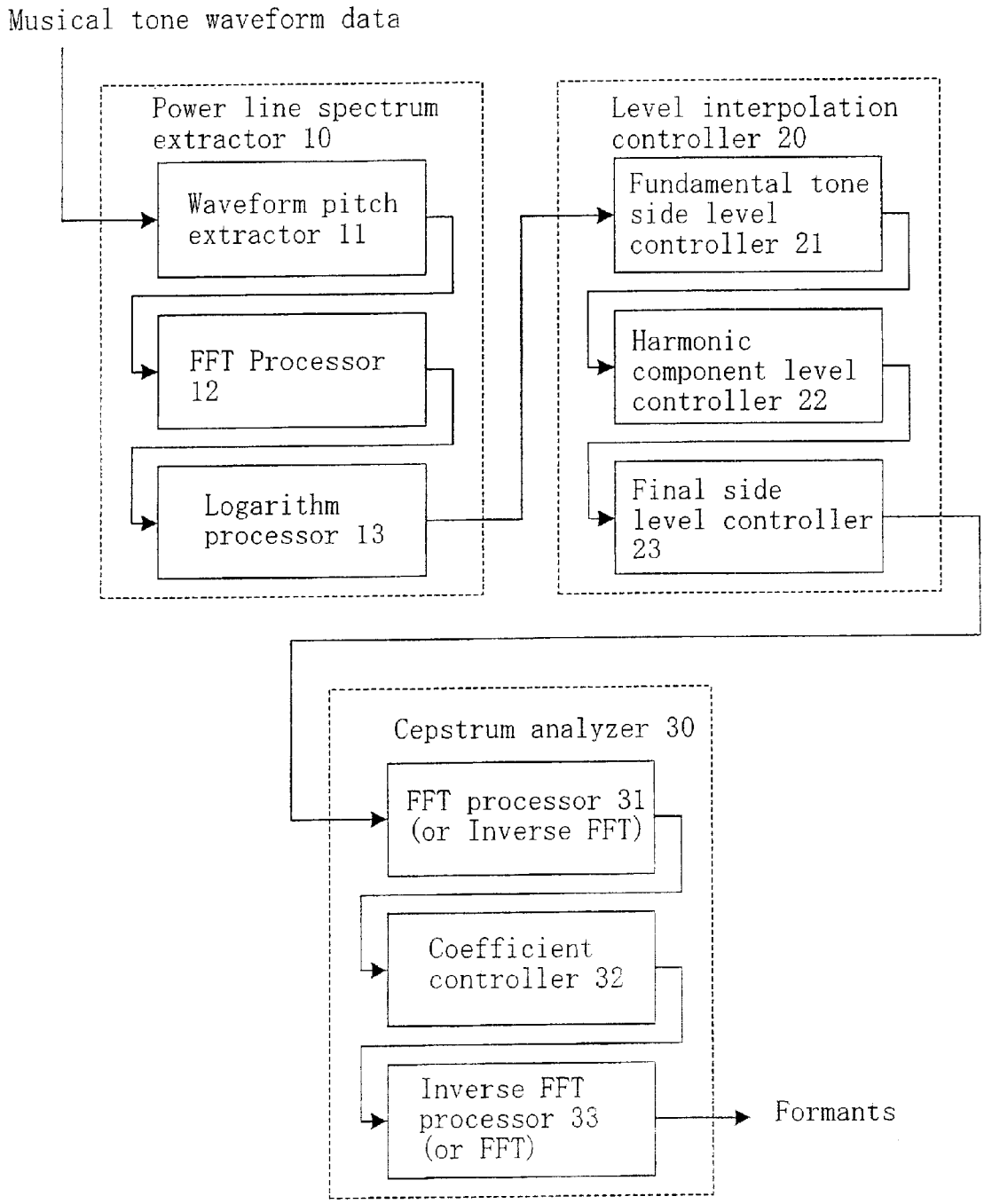
FIG. 1 is a functional diagram showing the arrangement according to an embodiment of the present invention.

FIG. 1 shows the arrangement according to an embodiment of the present invention. The arrangement comprises a power line spectrum extractor 10, a level interpolation controller 20 and a cepstrum analyzer 30, and the arrangement carries out the method according to the present invention.

When musical tone waveform data (PCM waveform data) are inputted into the power line spectrum extractor 10, power line spectra are extracted therein. The spectra are subsequently inputted into the level interpolation controller 20, where level interpolation control is performed on the spectra. The spectra, on which the level interpolation control has been performed, are inputted into the cepstrum analyzer 30, where cepstrum analysis is performed to input the spectra as formants.

The power line spectrum extractor 10, which is configured to extract the power line spectra of inputted waveform data, comprises a waveform pitch extractor 11, a Fast Fourier Transformation processor 12 and a logarithm processor 13.

Figure 2:
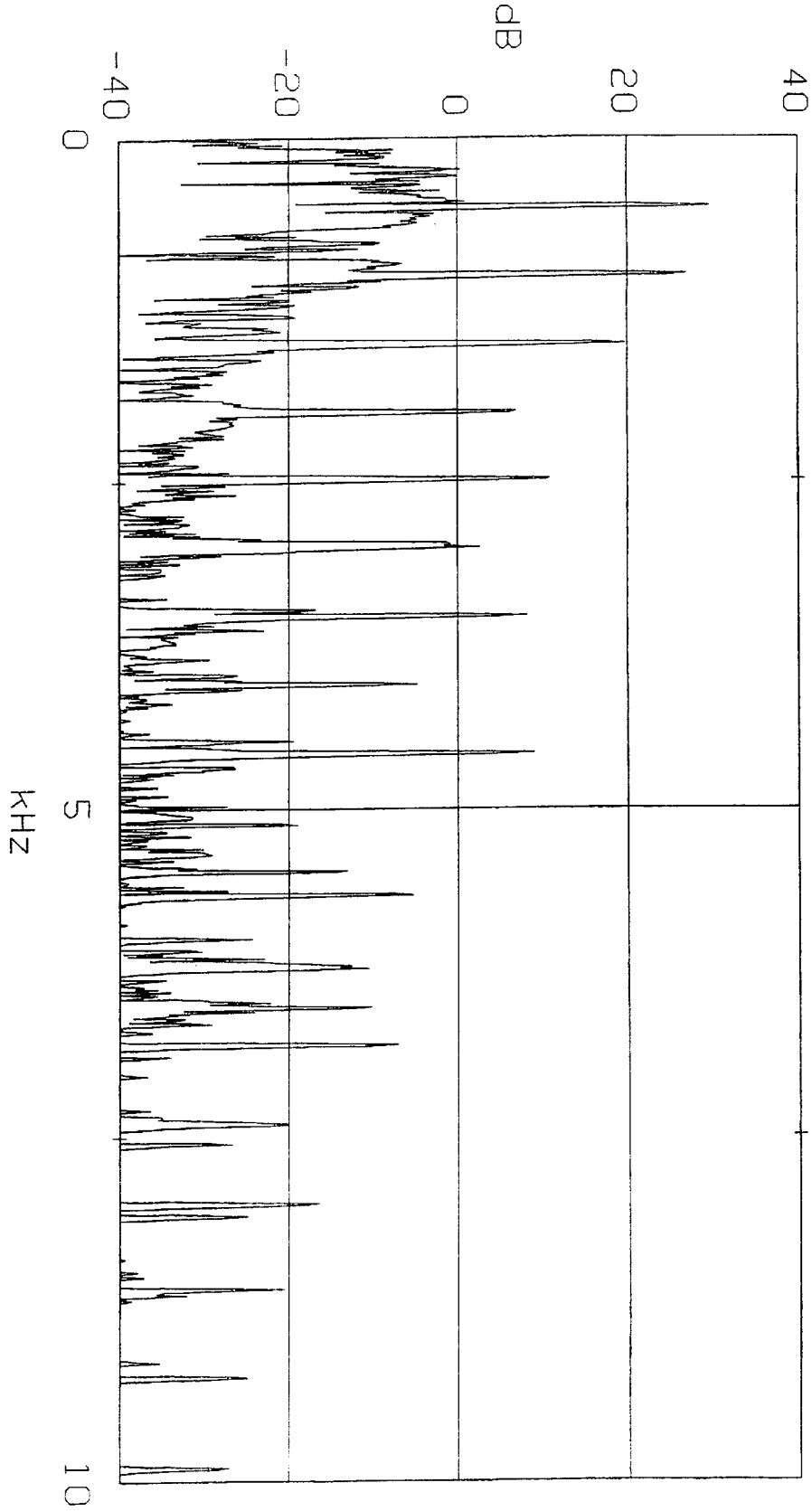
FIG. 2 is a waveform diagram showing power line spectra extracted by a power line spectrum extractor 10.

Among these members, the waveform pitch extractor 11 has a function to find the fundamental tone pitch of the inputted waveform data in accordance with an autocorrelation function or the like. Based on the fundamental tone pitch, the Fast Fourier Transformation processor 12 performs Fast Fourier Transformation, and logarithms of the amplitude spectra are taken to find the power line spectra as shown in FIG. 2.

The level interpolation controller 20, which is configured to perform level interpolation control to connect the peaks of harmonic components, comprises a fundamental tone side level controller 21, a harmonic component level controller 22 and a final side level controller 23.

Among these elements, the fundamental tone side level controller 21 has a function to find the frequency F1 and the level L1 of the spectrum having the greatest level before and after the fundamental tone of the inputted data and to bring all levels from the spectrum at 0 up to the spectrum at the frequency F1 to L1. Thus, the frequency components that are not harmonic components (frequency components having an integral harmonic relationship to the fundamental tone), and that are located in the vicinity of the fundamental tone and are not higher than the fundamental tone can maintain the levels.

At every frequency that is an integral multiple of the frequency of the fundamental tone and not higher than half a sampling frequency (which may be set at a lower frequency), the harmonic level controller 22 finds the frequency Fn and the level Ln of the spectrum having the greatest level before and after the respective integral multiple frequencies and repeats processing wherein the levels from the frequency having subjected to the level control at the previous stage to the frequency Fn are controlled to have values interpolated from a level Ln−1 to the level Ln.

The final side level controller 23 has a function to find the frequency FN and the level LN of the last harmonic component and to bring all levels from the frequency FN up to the frequency of the last harmonic set for the level interpolation control to LN.

Figure 3:
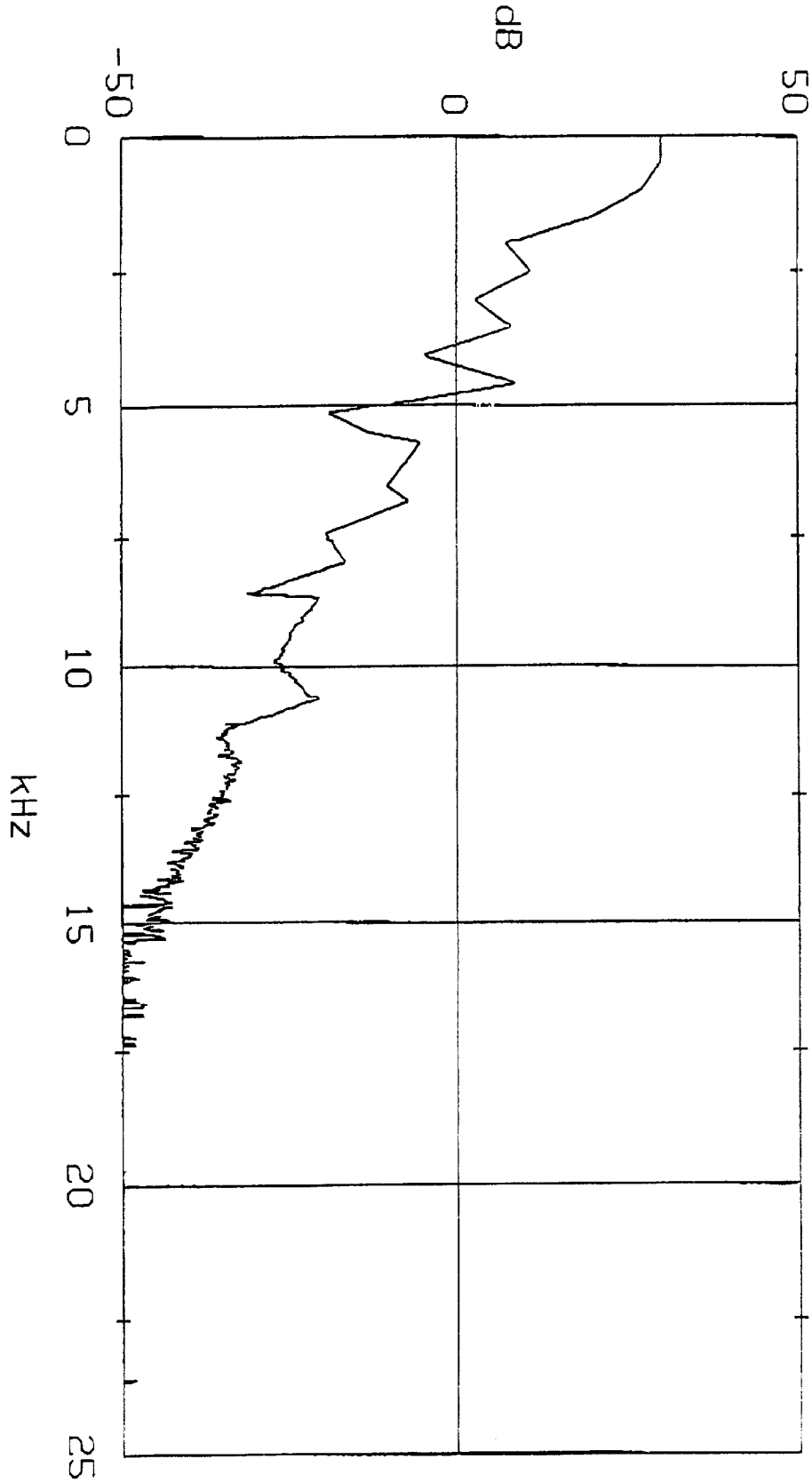
FIG. 3 is a waveform diagram showing a state wherein the spectra shown in FIG. 2 have been subjected to level interpolation control.

FIG. 3 shows the state wherein the spectra shown in FIG. 2 have been subjected to the level interpolation control as stated earlier.

The cepstrum analyzer 30, which is configured to perform cepstrum analysis on the spectra subjected to the level interpolation control as stated earlier to extract the spectra as formants, comprises a Fast Fourier Transformation (FFT) processor 31, a coefficient controller 32 and an Inverse Fourier Transformation (IFFT) processor 33.

Figure 4:
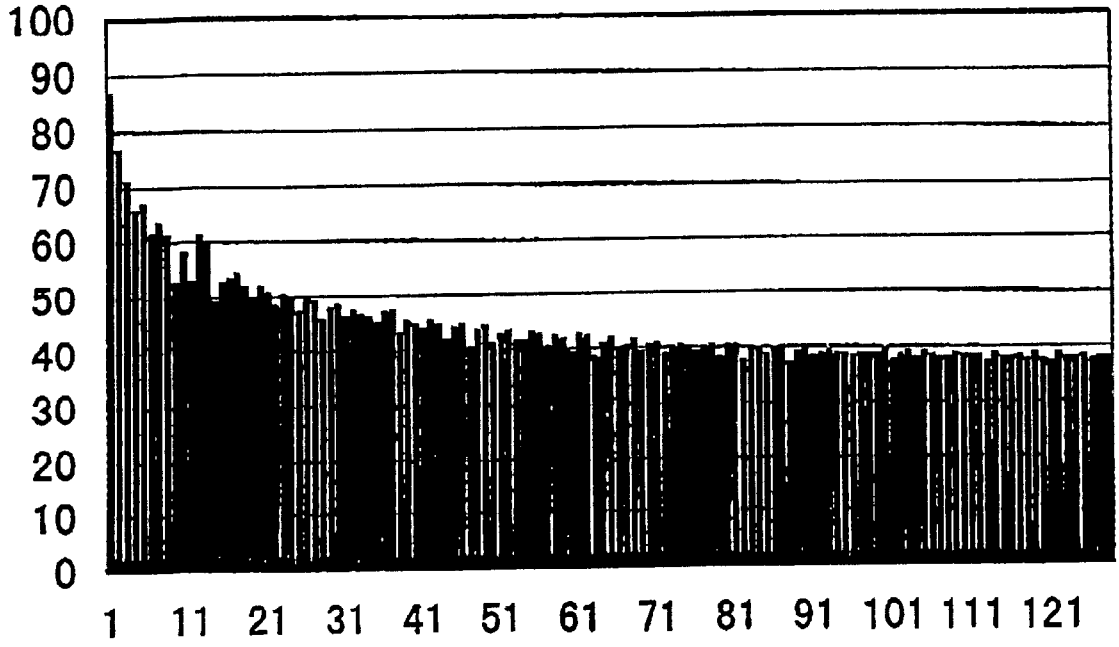
FIG. 4 is a waveform diagram showing a state wherein Fast Fourier Transformation is performed on the spectra subjected to the level interpolation control.

Among these elements, the Fast Fourier Transformation processor 31 has a function to perform Fast Fourier Transformation on the spectra subjected to the level interpolation control. By the way, the cepstrum is a technique for finding the periodicity of power spectra along the frequency axis and has the inverse number of a frequency as the dimension. The Fast Fourier Transformation processor is performed on the spectra again. When Fast Fourier Transformation is performed on the spectra that have been subjected to the level interpolation control shown in FIG. 3, the output results shown in FIG. 4 are obtained.

Since the processing step that is carried out in this Fast Fourier Transformation processor is the same as the processing step in the Fast Fourier Transformation processor 12, the same circuit arrangement or process routine can be basically utilized only by changing the coefficient. The Inverse Fourier Transformation can be expressed with the same formula as the Fourier Transformation and is different from the latter in term of only the difference of + and − in coefficient. For this reason, the Inverse Fourier Transformation processor 33 explained later can also share the arrangement with the relevant elements stated earlier. These three elements can utilize the same arrangement (process routine) to obtain desired power spectra without being provided with a special routine for other filtering.

Figure 5:
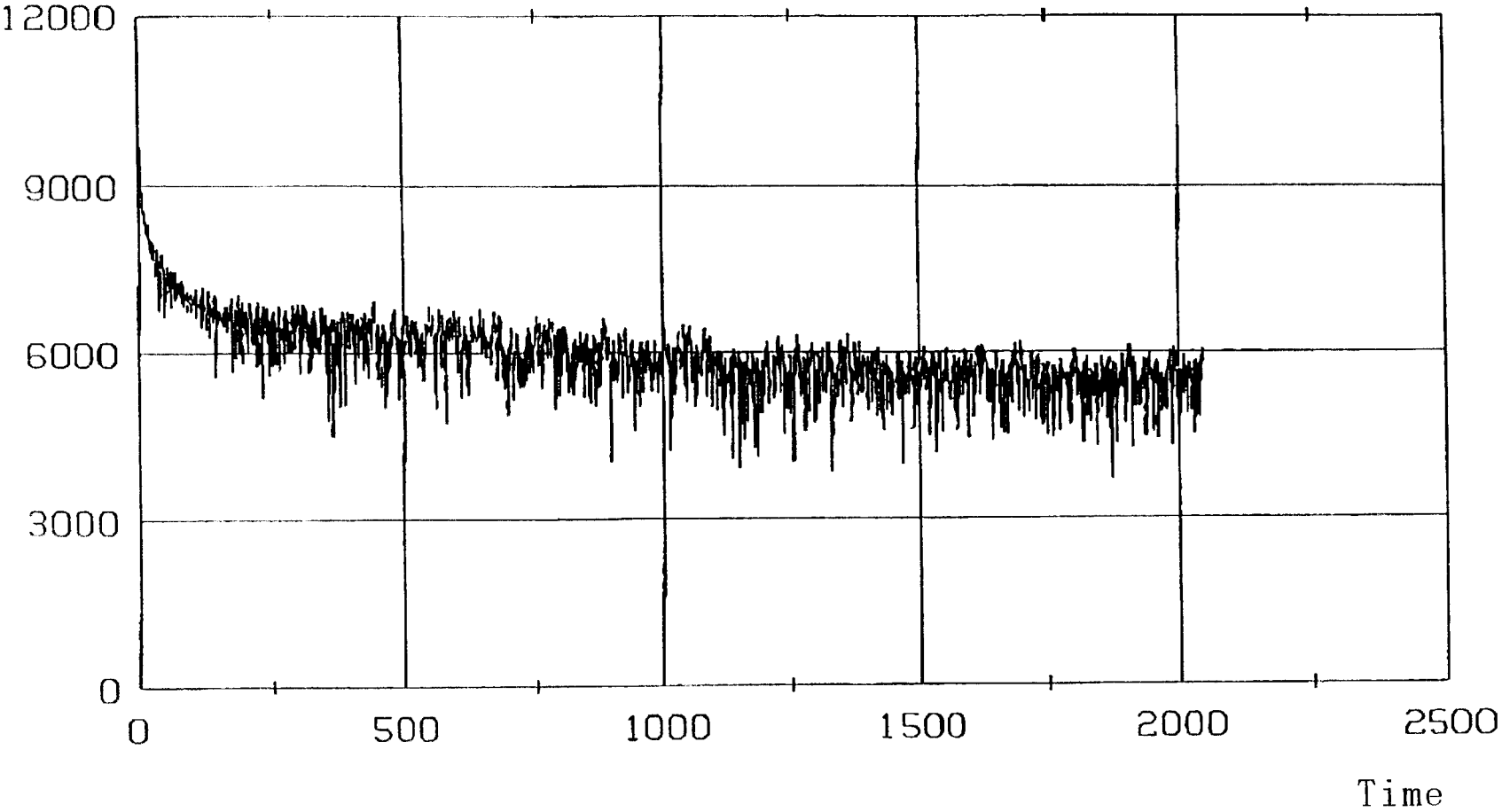
FIG. 5 a waveform diagram showing a state wherein Inverse Fast Fourier Transformation is performed on the spectra subjected to the level interpolation control.

This stage may be configured to perform the Inverse Fourier Transformation processing in place of the processing by the Fourier Transformation processor 31 since the Inverse Fourier Transformation is different from the Fourier Transformation in term of only coefficient and can be expressed with the same formula as the Fourier Transformation. In that case, the processing results shown in FIG. 5 are obtained.

The coefficient controller 32 performs processing wherein the levels that have a coefficient not smaller than a specified coefficient are all brought into 0. This is because only the formants that have a lower quefrency in the dimension of quefrency need to be extracted and be subjected to the Inverse Fourier Transformation (or FFT) for the purpose of extracting formants of an inputted signal in the cepstrum analysis since the fine structure of spectra appears at a higher quefrency while the spectral envelope (formants) appears at a lower quefrency. Although the coefficient may be set at an arbitrary value, the coefficient may be fixed as a proper value (e.g., about 5% in window size).

The Inverse Fourier Transformation processor 33 has a function to perform the Inverse Fourier Transformation processing on the values obtained by performing out the level setting by the coefficient as stated earlier. In other word, it is necessary to make conversion to power line spectrum fashion as in the original power line spectra in order to obtain the formants finally represented as an envelope since the transformation processing is carried out twice by the Fast Fourier Transformation processing in the cepstrum analysis in the embodiment.

The Fast Fourier Transformation processor 31 in the cepstrum analyzer 30 may be configured to perform the Inverse Fourier Transformation processing as stated earlier since both transformations are different only in terms of +or − in coefficient. When the Fast Fourier Transformation processor in the cepstrum analyzer is configured to perform the Inverse Fourier Transformation processing, the last processor 33 needs to be configured to perform the Fast Fourier Transformation processing without having the arrangement the Inverse Fast Fourier Transformation processor.

Figure 6:
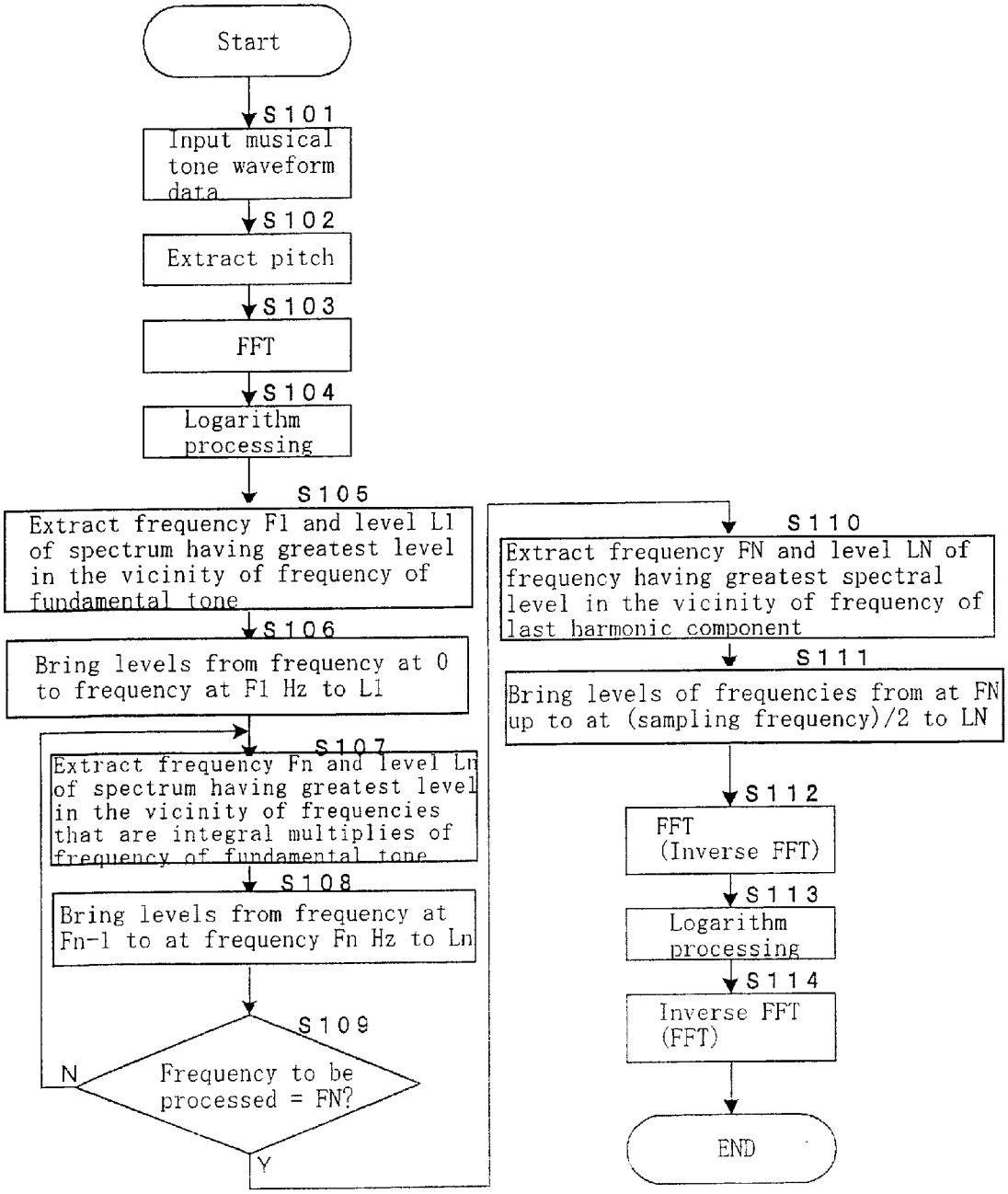
FIG. 6 is a flowchart showing the processing steps in the processing according to the embodiment.

FIG. 6 is a flowchart showing the processing steps in the embodiment. As shown in this figure, musical tone waveform data are inputted (Step S101), and the waveform pitch extractor 11 extracts the fundamental tone pitch from the inputted musical tone waveform data in the first instance (Step S102).

The Fast Fourier Transformation processor 12 performs Fast Fourier Transformation on the fundamental tone pitch (Step S103), and the logarithms of the amplitude spectra are taken (Step S104) to find power line spectra.

Next, the fundamental tone side level controller 21 finds the frequency F1 and the level L1 of the spectrum having the greatest level before and after the fundamental tone of the waveform data (Step S105) and brings all levels from the spectrum at 0 up to the spectrum at the frequency F1 to L1 (Step S106).

At every frequency that is an integral multiple of the frequency of the fundamental tone, the harmonic component level controller 22 finds the frequency Fn and the level Ln of the spectrum having the greatest level before and after the respective integral multiple frequencies (Step S107), and the processing wherein the levels from the frequency having subjected to the level control at the previous stage to the frequency Fn are controlled to have values interpolated from a level Ln−1 to the level Ln is carried out (Step S108). After that, it is checked out whether the frequency to be processed has reached the frequency FN of the last harmonic component (Step S109).

When the frequency to be processed has not reached the frequency FN (Step S109; No), the processing returns to Step S107 to repeat the steps stated above.

When the frequency to be processed has reached the frequency FN (Step S109; Yes), the final side level controller 23 finds the frequency FN and the level LN of the last harmonic component (Step S110) and to bring all levels from the frequency FN up to the frequency of the last harmonic component set for the level interpolation control to LN (Step S111).

Then, the Fast Fourier Transformation processor 31 performs Fast Fourier Transformation on the spectra, which have been subjected to the level interpolation control (Step S112).

After that, the coefficient controller 32 performs processing wherein the levels that have a coefficient not smaller than a specified coefficient are all brought into 0 (Step S113).

Finally, the Inverse Fourier Transformation processor performs the Inverse Fourier Transformation processing on the values obtained by carrying out the level setting with the coefficient as stated earlier (Step S114).

Figure 7:
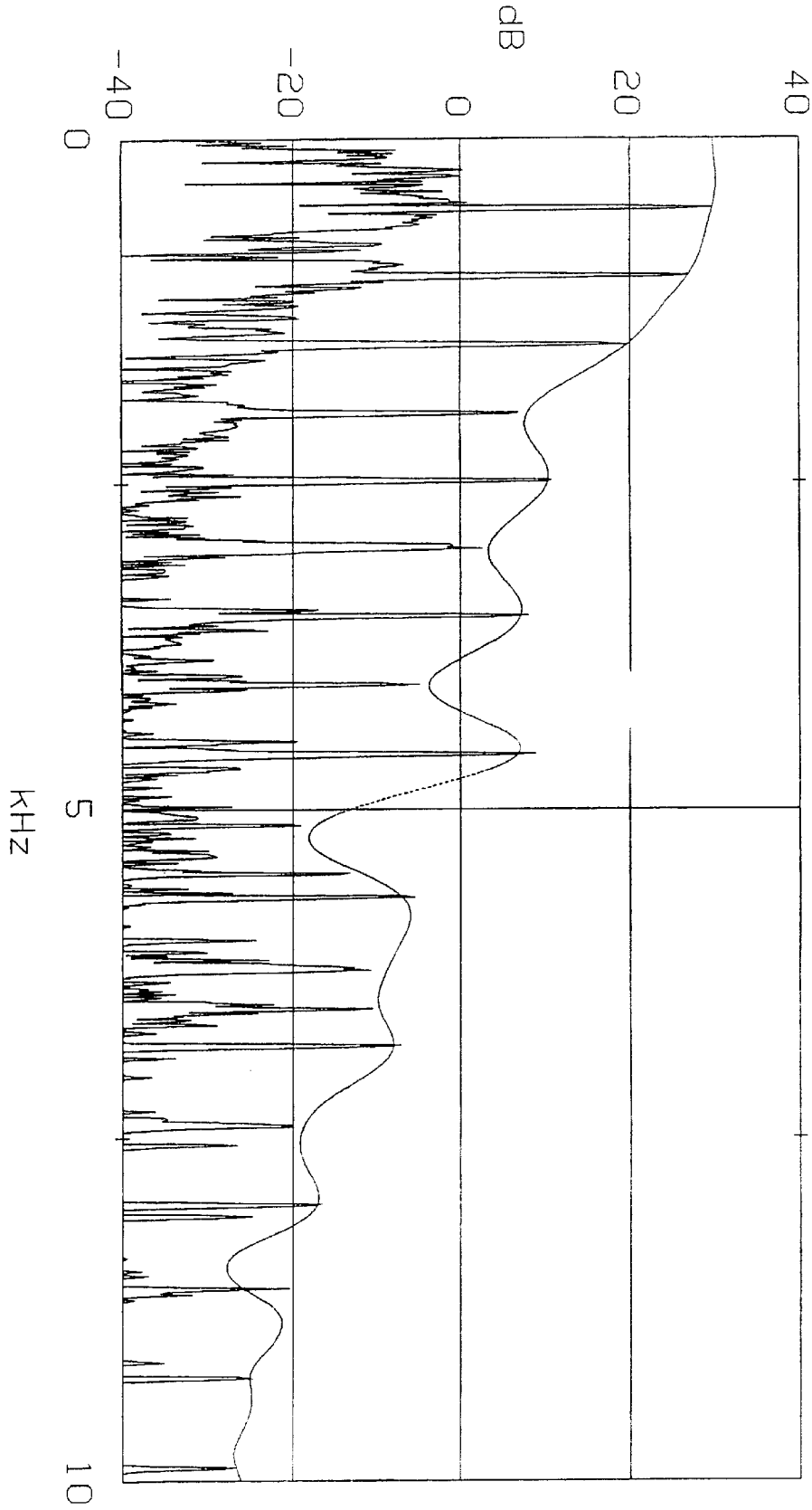
FIG. 7 is a waveform diagram showing the result of formant extraction that is obtained with the coefficient set at 80.
Figure 8:
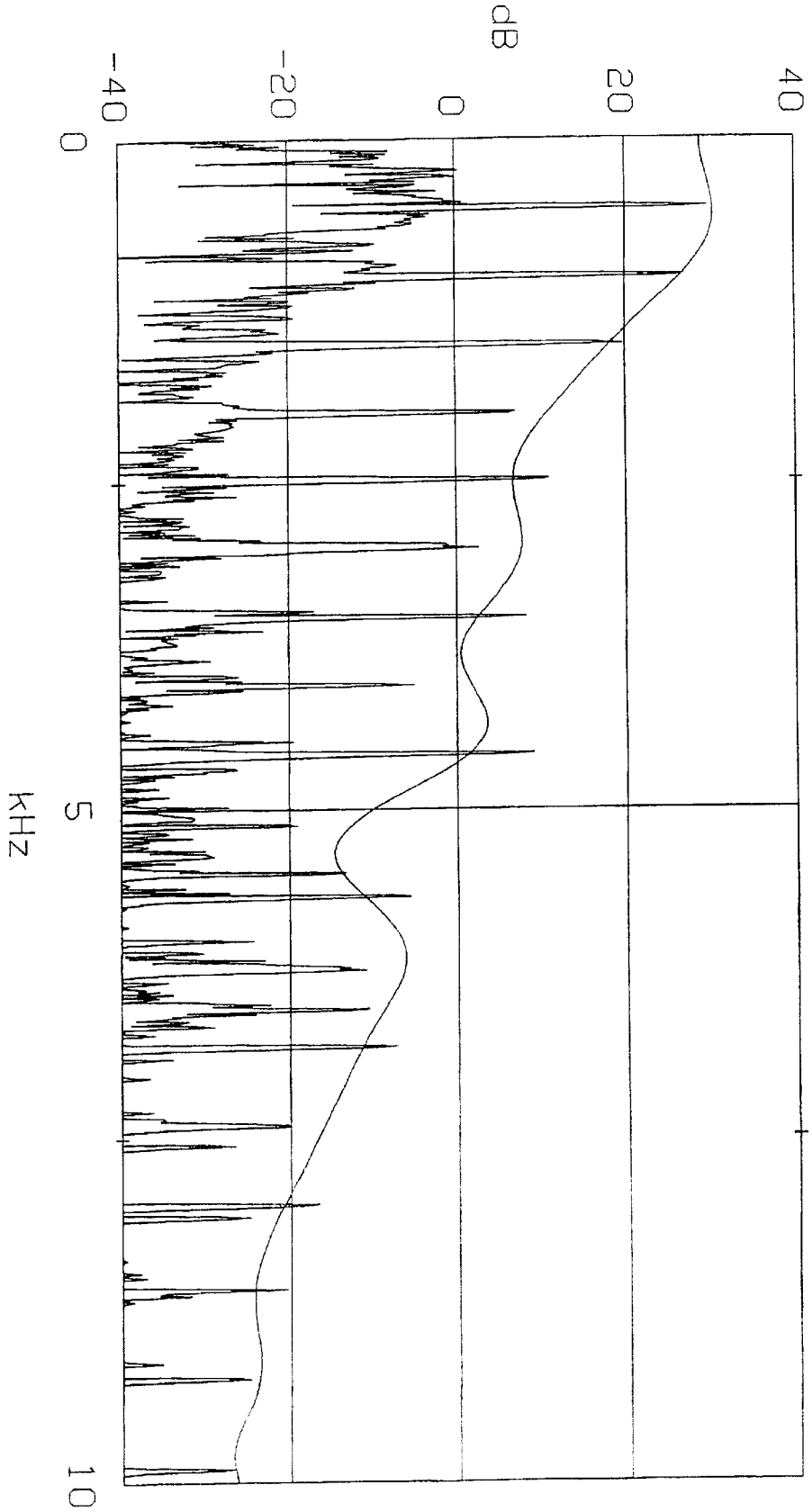
FIG. 8 is a waveform diagram showing the result of formant extraction that is obtained with the coefficient set at 40.

The result thus obtained can be provided as the formants shown as an envelope. FIG. 7 shows the result of formant extraction that has been obtained with the coefficient set at 80, and FIG. 8 shows the result of formant extraction that has been obtained with the coefficient set at 40.

Figure 9:
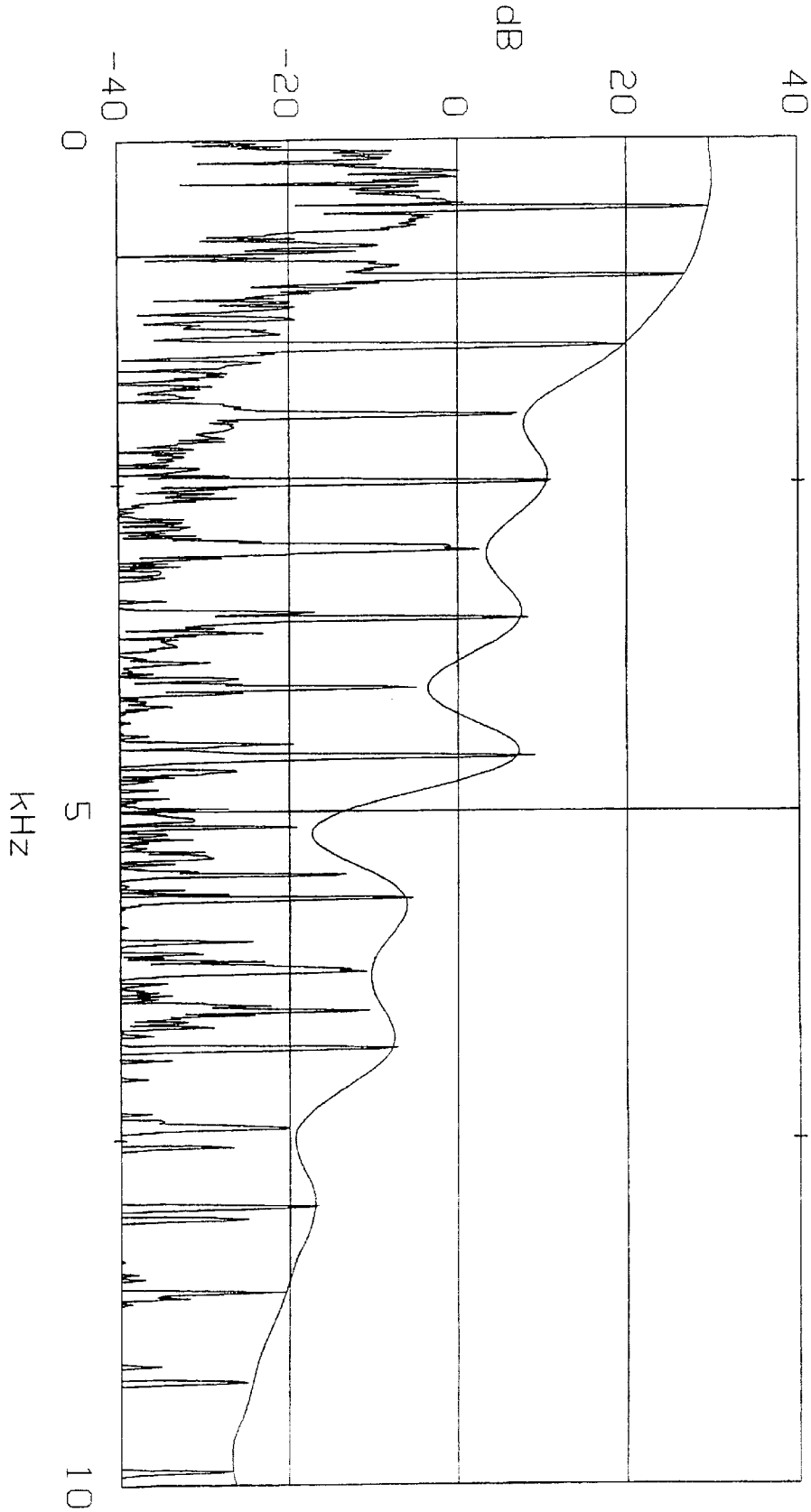
FIG. 9 is a waveform diagram showing the result of formant extraction that is obtained with the coefficient set at 80 when the level interpolation control of the power line spectra to be carried out at a certain unit of cycle is carried out at every cycle that is obtained by adding the frequency of a fundamental tone to the frequency found at a previous stage.
Figure 10:
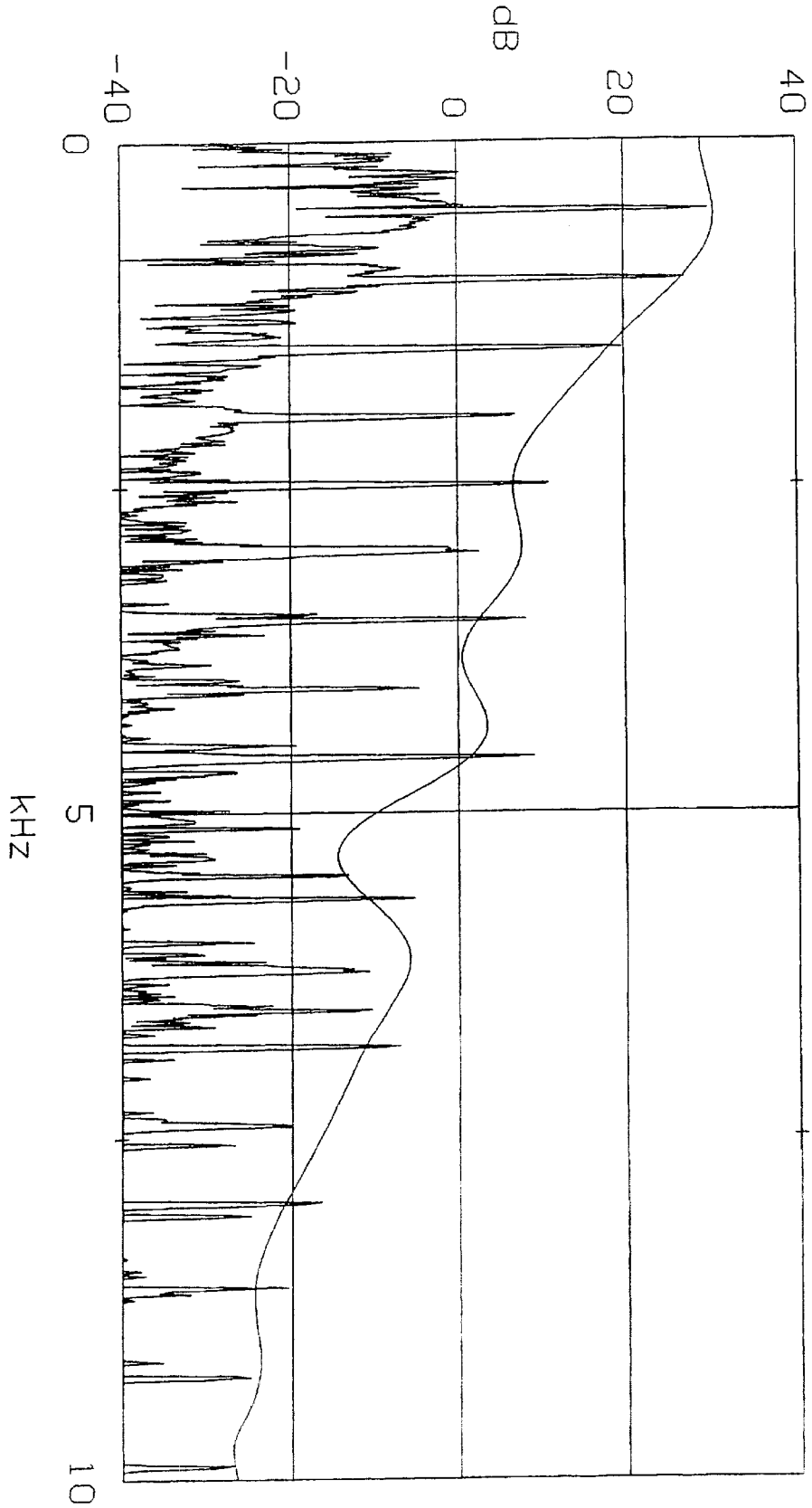
FIG. 10 is a waveform diagram showing the result of formant extraction that is obtained with the coefficient set at 40 when the level interpolation control is likewise carried out at every cycle that is obtained by adding the frequency of the fundamental tone to the frequency found at the previous stage.

With regard to the level interpolation control of the power line spectra to be carried out at every unit of a certain frequency in the harmonic component level controller 22 of the level interpolation controller 20, when the level interpolation control is carried out at every frequency that is obtained by adding the frequency of a fundamental tone to the frequency found at the previous stage instead of every frequency that is an integral multiple of the frequency of the fundamental tone as in the embodiment, the results shown in FIG. 9 and FIG. 10 can be obtained.

FIG. 9 shows the result of formant extraction that is obtained with the coefficient set at 80, and FIG. 10 shows the result of formant extraction that is obtained with the coefficient set at 40.

Figure 11:
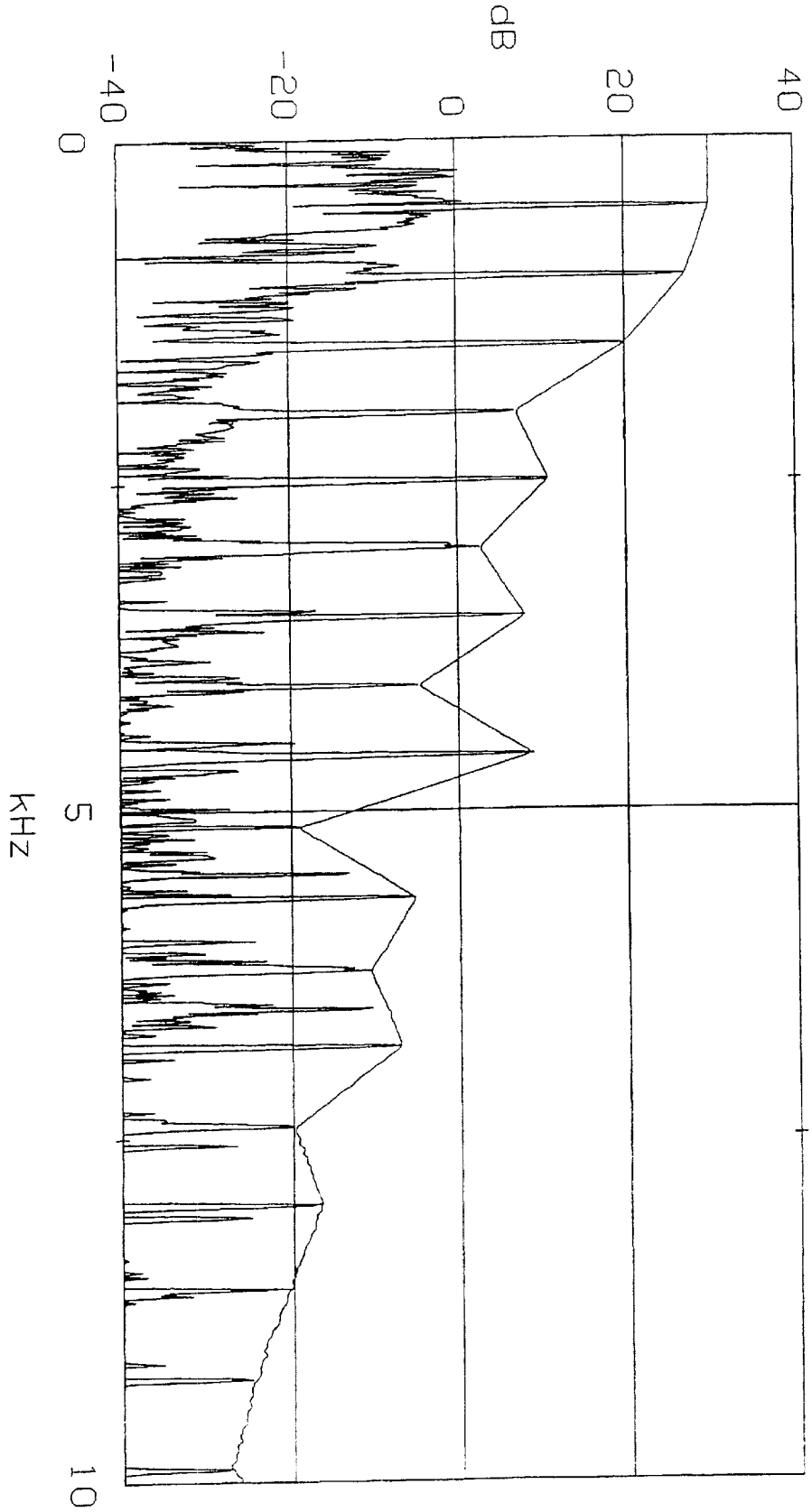
FIG. 11 is a waveform diagram showing the characteristics that are obtained after connecting the peaks of harmonic components obtained by the level interpolation control as stated earlier.
Figure 12:
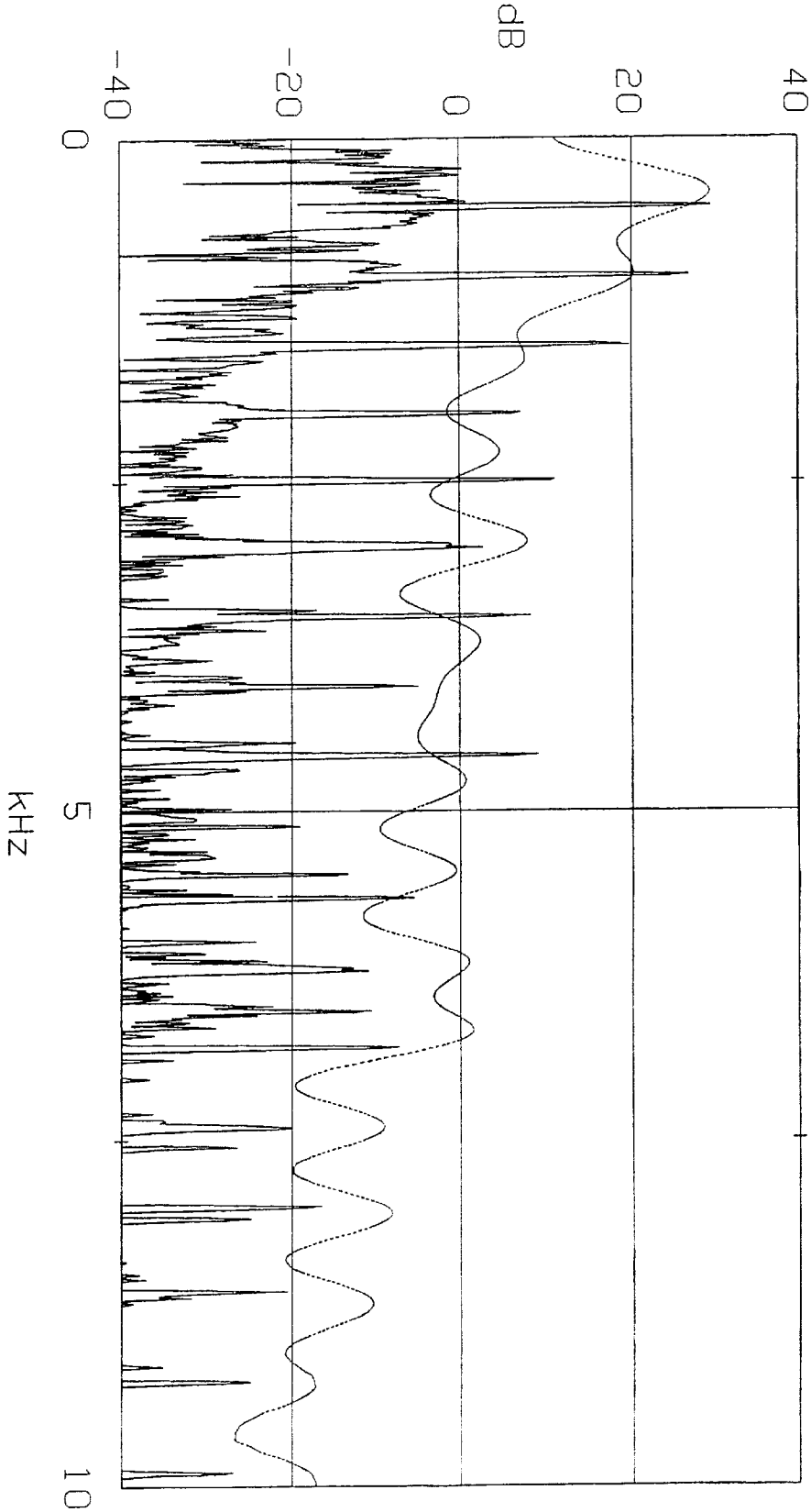
FIG. 12 is a waveform diagram showing power line spectra, wherein conventional cepstral analysis is performed with the coefficient set at 80.
Figure 13:
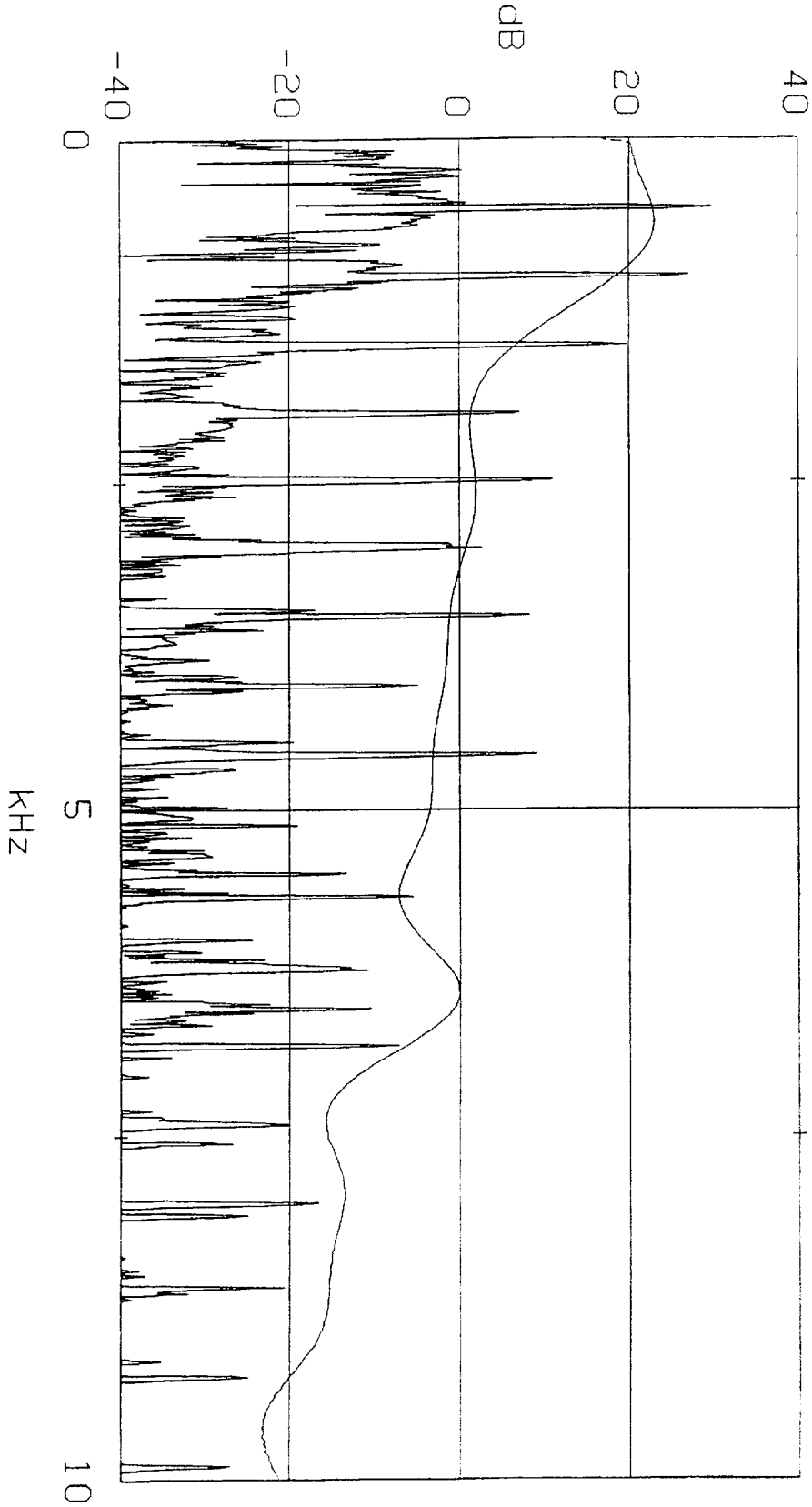
FIG. 13 is a waveform diagram showing power line spectra, wherein the conventional cepstral analysis is performed with the coefficient set at 40.
Figure 14:
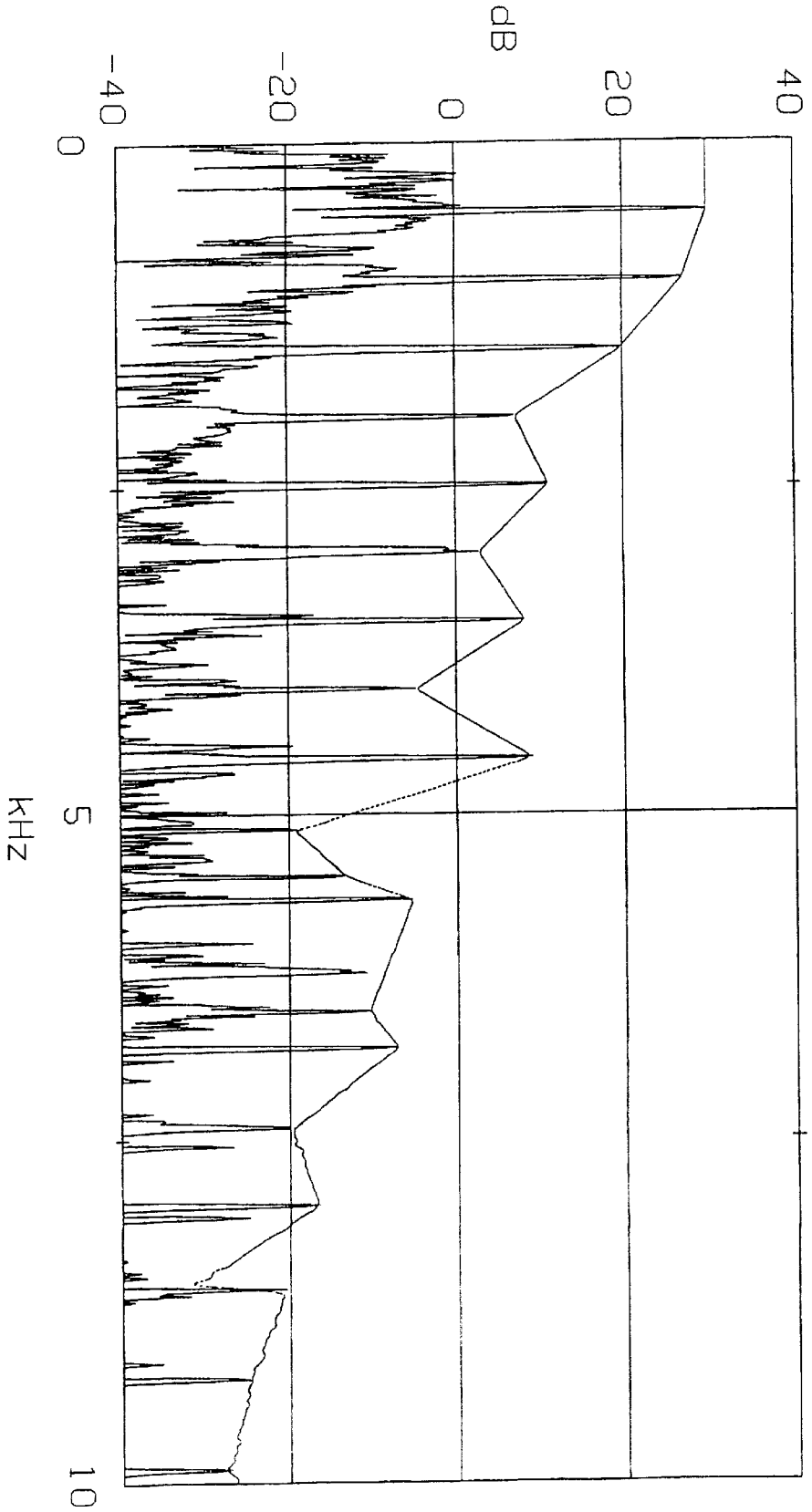
FIG. 14 is a waveform diagram showing the states of power line spectra and a spectral envelope wherein data, which have the intervals of harmonic components expanding as the degree of harmonic components increases, are shown to have peaks extracted at every certain section by a computer.

The characteristics that are obtained by connecting the peaks of the harmonic components after the level interpolation control has been carried out by the harmonic component level controller 22 are shown in FIG. 11. As seen from this figure, the problem that the shape of a formant in the vicinity of the frequency at 8 kHz shown in FIG. 14 is out of alignment with the location of the peak of the harmonic component is solved. It is supposed that the shape of the formant is in alignment with the location of the peak of the harmonic component to avoid misalignment since the level interpolation control is carried out with a subsequent peak point being found while adding the frequency of a fundamental tone to the peak point at the previous stage.

In this manner, it becomes possible to obtain formant data wherein components in the vicinity of a fundamental tone (in particular frequency components not higher than the fundamental tone) can be prevented from getting smaller, the levels of harmonic components inherent in the waveform are reflected with fidelity, a rough shape of the frequency characteristics is represented, and the characteristics of the original power line spectra are clearly shown.

The arrangement according to the present invention is not limited to the embodiment stated earlier. Various modifications are of course possible without departing the sprit of the invention. For example, the arrangement according to the present invention can be applied as a sound generator for a sing-along machine, an electronic instrument or a computer to extract formants that can reflect the entire characteristics of sampled musical tone waveform data. By application of the arrangement, a new sound effect that has not been provided by conventional sing-along machines or electronic instruments, such as sing in Frank Sinatra's voice and generation of a musical tone from an electronic instrument, can be added.

What is claimed as new and desired to be Secured by Letters Patent of the United States is:

1. A method for extracting formants of a musical tone comprising the steps of:

finding power line spectra of a waveform to be processed;

performing level interpolation control on the power line spectra at every unit of a certain frequency, which is up to and including half a sampling frequency;

performing Inverse Fast Fourier Transformation or Fast Fourier Transformation on the power spectra subjected to the level interpolation control;

performing level setting with a specified coefficient; and performing Inverse Fast Fourier Transformation or Fast Fourier Transformation on values found by performing the level setting with the specified coefficient.

2. The method for extracting formants of a musical tone according to claim 1, wherein the step of performing level interpolation control comprises finding a frequency F1 and a level L1 of a spectrum having a maximum level before and after a fundamental tone of the waveform; bringing all levels of the power line spectra at 0 up to the frequency F1 into L1; repeating processing wherein, at every frequency that is an integral multiple of a frequency of the fundamental tone and half the sampling frequency at the maximum, a frequency Fn and a level Ln of a spectrum having a maximum level are found before and after the respective integral multiplied frequencies, and the levels from the frequency having subjected to the level control at the previous stage to the frequency Fn are controlled to have values interpolated from a level Ln−1 to the level Ln; finding a frequency FN and a level LN of a last harmonic component; and bringing all levels from the frequency FN up to the frequency of the last harmonic component set for the level interpolation control to LN.

3. The method for extracting formants of a musical tone according to claim 1, wherein the step of performing level interpolation control comprises finding a frequency F1 and a level L1 of a spectrum having a maximum level before and after a fundamental tone of the waveform; bringing all levels of the power line spectra at 0 up to the frequency F1 into L1; repeating processing wherein a frequency Fn and a level Ln of a spectrum having a maximum level are found before and after respective frequencies that are obtained by adding the frequency of the fundamental tone to a frequency Fn−1 found at the previous stage and are up to and including half the sampling frequency, and the levels from the frequency Fn−1 to the frequency Fn found at the previous stage are controlled to have values interpolated from a level Ln−1 to the level Ln; finding a frequency FN and a level LN of a last harmonic component; and bringing all levels from the frequency FN up to the frequency of the last harmonic component set for the level interpolation control to LN.

4. A computer-readable recording medium having a program saved thereto, the program causing a computer to perform the steps;

finding power line spectra of a waveform to be processed;

performing level interpolation control on the power line spectra at every unit of a certain frequency, which is up to and including half a sampling frequency;

performing Inverse Fast Fourier Transformation or Fast Fourier Transformation on the power spectra subjected to the level interpolation control;

performing level setting with a specified coefficient; and performing Inverse Fast Fourier Transformation or Fast Fourier Transformation on values found by performing the level setting with the specified coefficient.

5. The computer-readable recording medium according to claim 4, wherein the step of performing level interpolation control comprises finding a frequency F1 and a level L1 of a spectrum having a maximum level before and after a fundamental tone of the waveform; bringing all levels of the power line spectra at 0 up to the frequency F1 into L1; repeating processing wherein, at every frequency that is an integral multiple of a frequency of the fundamental tone and is up to and including half a sampling frequency, a frequency Fn and a level Ln of a spectrum having a maximum level are found before and after the respective integral multiplied frequency, and a levels from the frequency having subjected to the level control at the previous stage to the frequency Fn are controlled to have values interpolated from a level Ln−1 to the level Ln; finding a frequency FN and a level LN of a last harmonic component; and performing level interpolation control to connect peaks of harmonic components by bringing all levels from the frequency FN up to the frequency of the last harmonic component set for the level interpolation control to LN.

6. The computer-readable recording medium according to claim 4, wherein the step of performing level interpolation control comprises finding a frequency F1 and a level L1 of a spectrum having a maximum level before and after a fundamental tone of the waveform; bringing all levels of the power line spectra at 0 up to the frequency F1 into L1; repeating processing wherein a frequency Fn and a level Ln of a spectrum having a maximum level are found before and after respective frequencies that are obtained by adding the frequency of the fundamental tone to a frequency Fn−1 found at the previous stage and are up to and including half a sampling frequency, and the levels from the frequency Fn−1 to the frequency Fn found at the previous stage are controlled to have values interpolated from a level Ln−1 to the level Ln; finding a frequency FN and a level LN of a last harmonic component; and performing level interpolation control to connect peaks of harmonic components by bringing all levels from the frequency FN up to the frequency of the last harmonic component set for the level interpolation control to LN.

7. An Apparatus for extracting formants of a musical tone comprising:

a power line spectrum extractor, which extracts power line spectra of waveform to be processed;

a level interpolation adjuster, which performs level interpolation control on the power line spectra at every unit of a certain frequency, which is up to and including half a sampling frequency; and a cepstrum analyzer, which performs Fast Fourier Transformation or Inverse Fast Fourier Transformation on the power spectra subjected to the level interpolation control and performs Inverse Fast Fourier Transformation or Fast Fourier Transformation on values found by performing level setting with a specified coefficient.

* * * * *